US008261753B2

(12) United States Patent
Newman et al.

(10) Patent No.: US 8,261,753 B2
(45) Date of Patent: Sep. 11, 2012

(54) WIG WITH INTEGRAL CLINGING FOUNDATION

(75) Inventors: Shmuel Dovid Newman, Redondo Beach, CA (US); Yitzchok Geisinsky, Long Beach, CA (US); Yehudis Geisinsky, Long Beach, CA (US)

(73) Assignee: NG Imports, Signal Hill, CA (US)

( * ) Notice: Subject to any disclaimer, the term of this patent is extended or adjusted under 35 U.S.C. 154(b) by 246 days.

(21) Appl. No.: 12/626,468

(22) Filed: Nov. 25, 2009

(65) Prior Publication Data

US 2011/0120485 A1 May 26, 2011

(51) Int. Cl.
*A41G 5/00* (2006.01)

(52) U.S. Cl. ..... 132/54; 132/53

(58) Field of Classification Search ..... 132/201, 132/53–56

See application file for complete search history.

(56) References Cited

U.S. PATENT DOCUMENTS

| | | | | |
|---|---|---|---|---|
| 3,672,362 | A | 6/1972 | Basche | |
| 3,862,638 | A * | 1/1975 | Fannin | 132/53 |
| 5,647,384 | A | 7/1997 | Haber et al. | |
| 5,988,177 | A | 11/1999 | Bate | |
| 6,352,079 | B1 * | 3/2002 | Bate | 132/54 |
| 2009/0071490 | A1 * | 3/2009 | Sthair | 132/105 |

* cited by examiner

*Primary Examiner* — Rachel Steitz
(74) *Attorney, Agent, or Firm* — Lance M. Pritikin, Esq.

(57) ABSTRACT

A wig with integral clinging foundation for enhanced securement of the wig to the head of a wearer. A plurality of hair strands are attached to a foundation base element. One or more securement elements are connected to the periphery of the foundation base element. Each securement element is flexible and has an inner surface including unidirectional piled fiber adapted to cause frictional engagement between the securement element and a portion of either the skin or the natural hair of the head of the wearer. The frictional engagement occurs in a frictional direction which is generally toward the crown portion of the foundation base element. As a result, the wig can be easily slipped onto the head of a wearer, yet remain effectively secured thereto. Thus, the construction of the wig allows it to be worn securely, comfortably and universally for wearers with and without their own natural hair.

4 Claims, 3 Drawing Sheets

WIG WITH INTEGRAL CLINGING FOUNDATION

RELATED APPLICATIONS

Not Applicable.

TECHNICAL FIELD OF THE INVENTION

The present invention relates generally to the field of wigs. More particularly, the invention concerns a wig with an improved foundation structure which enhances the securement of the wig to the head of the wearer.

BACKGROUND OF THE INVENTION

Wigs are used to provide a variety of hairstyles for those who have experienced significant or total hair loss, as well as those who still have all or most of their own natural hair. For those who have very little or none of their own natural hair, it can be difficult to effectively anchor a wig or other hairpiece to their head without using adhesives or tapes that can be inconvenient or irritating to their skin. For those who still have most or all of their own natural hair, modern wigs commonly require the use of one or more clips to anchor the wig foundation to their natural hair. It is common, in fact, for such clips to be integrated within the foundation of the wig itself. Over time, such clips can cause localized trauma to the scalp and natural hair of the wearer, often resulting in the formation of bald spots at the clip locations.

Those in the art are well aware of the challenges of producing a wig with an effective fully-integrated anchoring system, for use by those with and without their own natural hair, and which does not cause some form of inconvenience, discomfort or injury to the wearer. These challenges are compounded substantially when coupled with the universal desire to reduce manufacturing costs. Accordingly, there exists a need for a less-expensively produced wig with an integral foundation that provides enhanced securement of the wig to the head of a wearer in a manner which is comfortable, convenient, safe and effective. Just as importantly, there is a need for such a wig to perform universally for those wearers with and without their own natural hair.

SUMMARY OF THE INVENTION

By way of summary, the embodiments concern a wig with integral clinging foundation for enhanced securement of the wig to the head of a wearer.

Embodiments generally include a foundation base element, a plurality of strands of hair, and at least a first securement element. The foundation base element is substantially thin and flexible, and has an inner side, an outer side, a crown portion, a forward periphery, a rear periphery, a right periphery and a left periphery. Each of the plurality of hair strands is attached to the foundation base element and extend generally outward of the outer side. The first securement element is flexible and has a first inner surface and a first outer surface. The first securement element is in first connection with the foundation base element. The first inner surface includes unidirectional piled fiber adapted to cause a first frictional engagement between the first securement element and a first adjacent object in contact therewith so as to hinder movement of the first securement element in a first frictional direction with respect to the first adjacent object.

In certain embodiments, the first connection is made proximate the forward periphery, while in other embodiments, the first connection may be made, for example, proximate the rear periphery.

Further embodiments comprise a second securement element. The second securement element is flexible and has a second inner surface and a second outer surface. The second securement element is in second connection with the foundation base element. The second inner surface includes unidirectional piled fiber adapted to cause a second frictional engagement between the second securement element and a second adjacent object in contact therewith so as to hinder movement of the second securement element in a second frictional direction with respect to the second adjacent object. In embodiments with first and second securement elements, it is typical for the first connection to be made proximate the forward periphery while the second connection is made proximate the rear periphery.

Particular embodiments further comprise a third securement element and a fourth securement element. The third securement element is flexible and has a third inner surface and a third outer surface. The third securement element is in third connection with the foundation base element. The third inner surface includes unidirectional piled fiber adapted to cause a third frictional engagement between the third securement element and a third adjacent object in contact therewith so as to hinder movement of the third securement element in a third frictional direction with respect to the third adjacent object. The third connection is made proximate the right periphery.

The fourth securement element is flexible and has a fourth inner surface and a fourth outer surface. The fourth securement element is in fourth connection with the foundation base element. The fourth inner surface includes unidirectional piled fiber adapted to cause a fourth frictional engagement between the fourth securement element and a fourth adjacent object in contact therewith so as to hinder movement of the fourth securement element in a fourth frictional direction with respect to the fourth adjacent object. The fourth connection is made proximate the left periphery.

In certain embodiments, the second, third, and fourth securement elements may each also include a readily reshapable strip therein. The shape of the readily reshapable strip is adjustable to provide additional pressure between the second, third and fourth inner surfaces and the second, third and fourth adjacent objects, respectively.

In embodiments, the first, second, third and fourth adjacent objects, where applicable, are typically separate portions of either the skin of the wearer or the natural hair of the wearer (more particularly, the skin or natural hair of the head of the wearer). The first, second, third and fourth frictional directions are generally toward the crown portion. Each frictional engagement and their respective frictional directions, individually and (where applicable) in combination, contributes to the enhanced securement of the wig to the head of the wearer.

Certain embodiments may also comprise an elastic band extending generally from the right periphery, along the rear periphery and to the left periphery. The elastic band may also have a length that is adjustable, for example, by way of a small conventional quick-release clip.

The detailed description of embodiments of the wig with integral clinging foundation is intended to serve merely as examples, and is in no way intended to limit the scope of the appended claims to these described embodiments. Accordingly, modifications to the embodiments described are possible, and as will be clearly understood by those skilled in the art, the invention may be practiced in many different ways than the embodiments specifically described below, and still remain within the scope of the claims.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
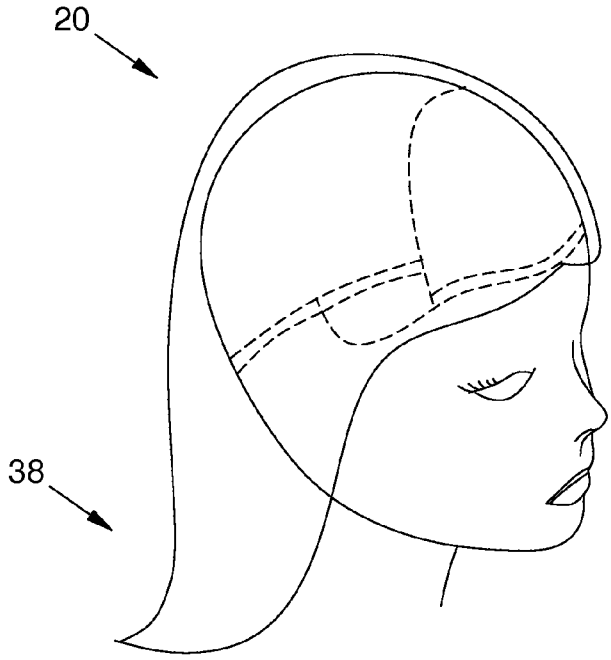
FIG. 1 is a diagrammatic perspective view of a wig with integral clinging foundation in accordance with the present invention, shown secured to the head of a wearer.

While the invention is susceptible to various modifications and alternative forms, specific embodiments thereof are shown by way of example in the drawings and may herein be described in detail. The drawings may not be to scale. It should be understood, however, that the drawings and the detailed description thereto are not intended to limit the invention to the particular for disclosed, but to the contrary, the intention is to cover all modifications.

DETAILED DESCRIPTION OF THE INVENTION

Referring particularly to the FIGS. for the purposes of illustration of the best modes only, and not limitation, FIG. 1 depicts an embodiment of a wig with integral clinging foundation generally at 20, comprising, in part, a plurality of hair strands shown generally at 38.

Figure 2:
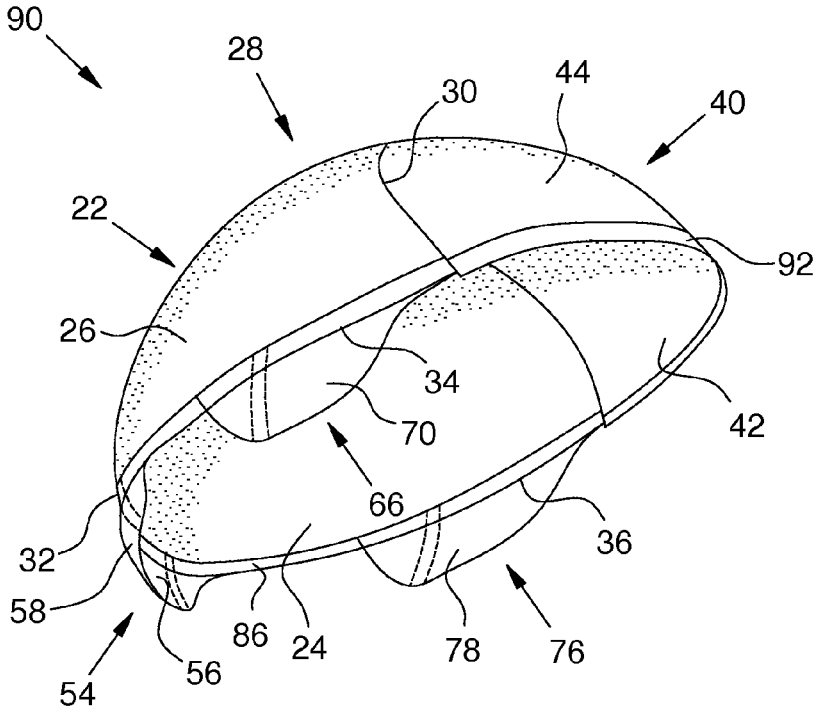
FIG. 2 is a diagrammatic perspective view of a wig with integral clinging foundation in accordance with the present invention, but shown without the plurality of hair strands attached to the foundation base element.
Figure 7:
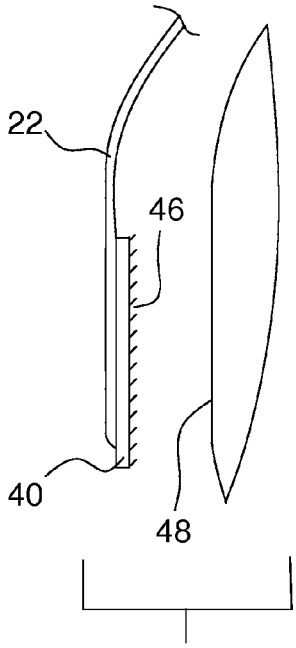
FIG. 7 is a diagrammatic partial cross-sectional view of an embodiment illustrating the unidirectional piled fiber of the first inner surface of the first securement fabric element in proximity to a first adjacent object such as a portion of the skin of a wearer.
Figure 8:
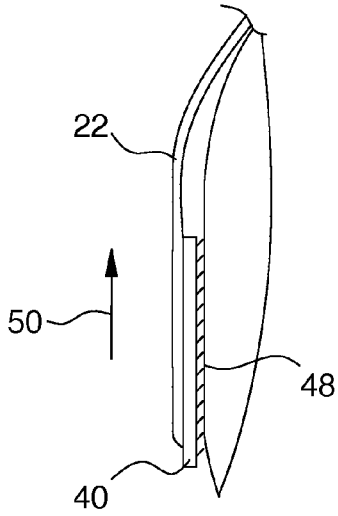
FIG. 8 is a diagrammatic partial cross-sectional view similar to that shown in FIG. 7, but in which the first adjacent object is shown in contact with the first securement fabric element so as to hinder movement of the first securement fabric element in a first frictional direction with respect to the first adjacent object.
Figure 9:
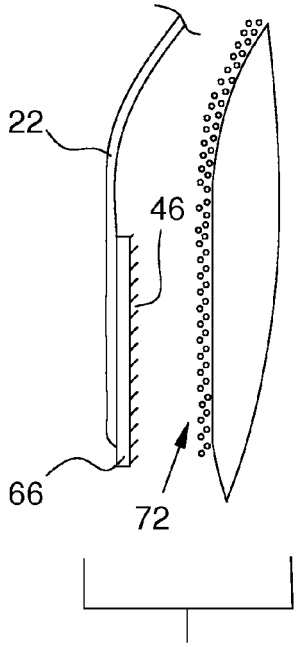
FIG. 9 is a diagrammatic partial cross-sectional view of an embodiment illustrating the unidirectional piled fiber of the third inner surface of the third securement fabric element in proximity to a third adjacent object such as a portion of the natural hair of a wearer.
Figure 10:
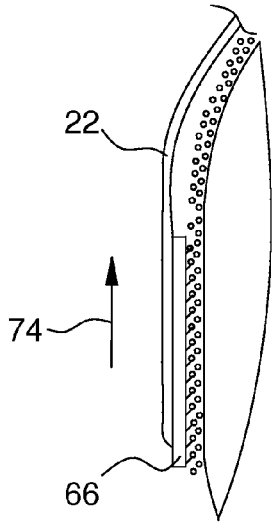
FIG. 10 is a diagrammatic partial cross-sectional view similar to that shown in FIG. 9, but in which the third adjacent object is shown in contact with the third securement fabric element so as to hinder movement of the third securement fabric element in a third frictional direction with respect to the third adjacent object.

FIG. 2 depicts a clinging foundation of a wig 20 generally at 90. The foundation base element, shown generally at 22, is substantially thin and flexible, and has an inner side 24, an outer side 26, a crown portion 28, a forward periphery 30, a rear periphery 32, a right periphery 34 and a left periphery 36. The foundation base element 22 is generally made of a porous or net-like material which permits the sturdy attachment of hair strands thereto. Each of the plurality of hair strands 38 is attached to the foundation base element 22 by conventional means and extend generally outward of the outer side 26. The first securement fabric element 40 is flexible and has a first inner surface 42 and a first outer surface 44. The first securement fabric element 40 is in first connection with the foundation base element 22. The first inner surface 42 includes unidirectional piled fiber 46 adapted to cause a first frictional engagement between the first securement fabric element 40 and a first adjacent object (see, for example, 48 in FIGS. 7-8) in contact therewith so as to hinder movement of the first securement fabric element 40 in a first frictional direction (see, for example, 50 in FIGS. 3 and 8) with respect to the first adjacent object 48.

Turning now to FIGS. 7-10 for illustration, the securement fabric elements discussed herein (such as those shown at 40 and 66) can be made from individual pieces of unidirectionally piled fabric. It is important to note, however, that basic velvet or velour-like materials are generally not sufficient for use in forming the securement fabric elements, because their piled fiber is not necessarily inherently unidirectionally oriented, and therefore does not produce a unidirectional frictional engagement when placed in contact with an adjacent object. Rather, it is essential that the selected material, whether a type of velour, velvet, or another piled fabric, includes piled fiber which is unidirectionally oriented. The unidirectional orientation of the piled fibers 46 of such materials (see, for example, FIGS. 7-10) provides these unidirectional frictional properties. As a result of these unidirectional frictional properties, when such material is placed in contact with an adjacent object such as skin or hair (illustrated, for example, at 48 and 72, respectively), the material will frictionally engage that object substantially upon relative movement in one direction (such as those shown at 50 and 74, for example), but far less so upon movement in the opposite direction.

Importantly, when pieces of such material are applied and oriented optimally as part of a wig foundation, these unidirectional frictional properties advantageously allow the wig to more easily slide onto the head of a wearer, while simultaneously enhancing the securement of the wig thereto. Further, the softness of the material enhances comfort to the wearer, in contrast to the clips common in prior art wig systems. The securement fabric elements can be a variety of shapes and sizes, depending on the particular configuration of the wig and the desired frictional properties. For example, a larger securement fabric element placed on one side of the clinging foundation can provide greater friction to counteract the weight of a larger mass of hair hanging on the opposite side.

In certain embodiments, the first connection is made proximate the forward periphery 30, while in other embodiments, the first connection may be made, for example, proximate the rear periphery 32. Such connections, as generally discussed herein, may be made by stitching operation, adhesive bond, or other conventional connection means. Further, such connections may be made directly between the respective edges or peripheries of two interconnected elements, or there may, in some embodiments, be varying degrees of overlapping between interconnected elements. For example, where the securement fabric elements cover relatively large sections of the clinging foundation 90, it may be desirable for the foundation base element 22 to substantially overlap one or more of the securement fabric elements, so that hair strands can be attached to visually obscure the outside surface of those securement fabric elements.

Embodiments, such as those shown in FIGS. 1-6, in which the first securement fabric element 40 is in first connection with the foundation base element 22 at the forward periphery 30, typically include a front foundation strip 92 connected to the first securement fabric element 40. The front foundation strip 92 is made of thin, flexible net-like material and extends forward beyond the first securement fabric element 40 to the artificial hairline so as to mask the presence of the first securement fabric element 40 from the viewpoint of an observer. A further plurality of hair strands are applied to the front foundation strip 92, thereby creating the appearance of a natural hairline which does not risk visual exposure of the first securement fabric element 40 located rearwardly thereof.

Some embodiments may include an auxiliary foundation member made from, for example, a rubber-like compound with the appearance of a natural scalp to which further hair strands are attached. Such an auxiliary foundation member would typically be integrated toward the top-front portion of the wig 20 to enhance the realism of the scalp of the wearer where hair is parted. Also, where a larger securement fabric element is positioned toward the front of the head of the wearer in order to provide additional frictional engagement to offset the weight of the hair hanging from the back of the wig, such an auxiliary foundation member could be advantageously integrated with the remainder of the wig to cover up the larger securement fabric element.

Figure 3:
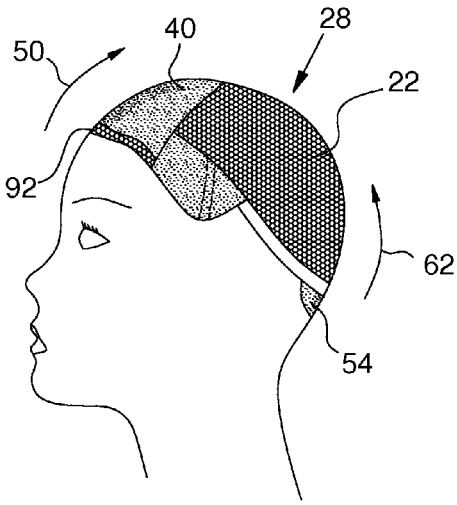
FIG. 3 is a diagrammatic side view of a wig with integral clinging foundation in accordance with the present invention, shown secured to the head of a wearer and without the plurality of hair strands attached to the foundation base element.
Figure 5:
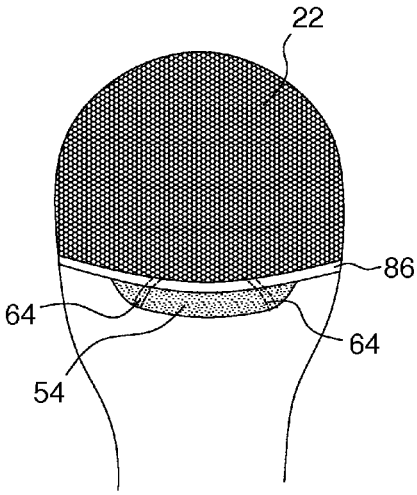
FIG. 5 is a diagrammatic rear view of the embodiment shown in FIG. 3.

Turning FIGS. 2, 3 and 5, further embodiments of a wig with integral clinging foundation 20 comprise a second securement fabric element 54. The second securement fabric element 54 is flexible and has a second inner surface 56 and a second outer surface 58. The second securement fabric element 54 is in second connection with the foundation base element 22. The second inner surface 56 includes unidirectional piled fiber 46 adapted to cause a second frictional engagement between the second securement fabric element 54 and a second adjacent object in contact therewith so as to hinder movement of the second securement fabric element 54 in a second frictional direction (see, for example, 62 in FIG. 3) with respect to the second adjacent object. In embodiments with first and second securement fabric elements 50 and 54, it is typical for the first connection to be made proximate the forward periphery 30 while the second connection is made proximate the rear periphery 32.

Particular embodiments further comprise a third securement fabric element 66 and a fourth securement fabric element 76. The third securement fabric element 66 is flexible and has a third inner surface (not shown) and a third outer surface 70. The third securement fabric element 66 is in third connection with the foundation base element 22. The third inner surface includes unidirectional piled fiber 46 adapted to cause a third frictional engagement between the third securement fabric element 66 and a third adjacent object (see, for example, 72 in FIGS. 9-10) in contact therewith so as to hinder movement of the third securement fabric element in a third frictional direction (see, for example, 74 in FIG. 4) with respect to the third adjacent object 72. The third connection is made proximate the right periphery 34.

The fourth securement fabric element 76 is flexible and has a fourth inner surface 78 and a fourth outer surface (not shown). The fourth securement fabric element is in fourth connection with the foundation base element. The fourth inner surface 78 includes unidirectional piled fiber 46 adapted to cause a fourth frictional engagement between the fourth securement fabric element 76 and a fourth adjacent object in contact therewith so as to hinder movement of the fourth securement fabric element 76 in a fourth frictional direction (see, for example, 84 in FIG. 4) with respect to the fourth adjacent object. The fourth connection is made proximate the left periphery 36.

Figure 6:
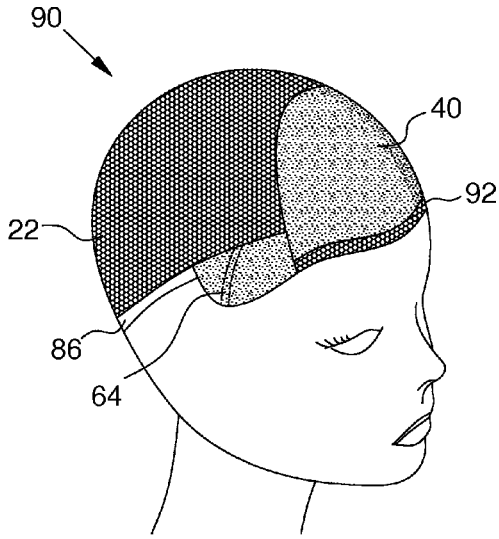
FIG. 6 is a diagrammatic perspective view of the embodiment shown in FIG. 3.

In certain embodiments, the second, third, and fourth securement fabric elements (illustrated, for example, at 54, 66 and 76, respectively) may each also include a readily reshapable strip 64 therein. Such reshapable strips 64 are typically a thin metal strip which the wearer can easily bend by hand and reform without the aid of tools. FIGS. 5 and 6 depict examples of where such reshapable strips 64 may be positioned. The shape of the readily reshapable strip 64 is adjustable to provide additional pressure between the second, third and fourth inner surfaces and the second, third and fourth adjacent objects, respectively.

Figure 4:
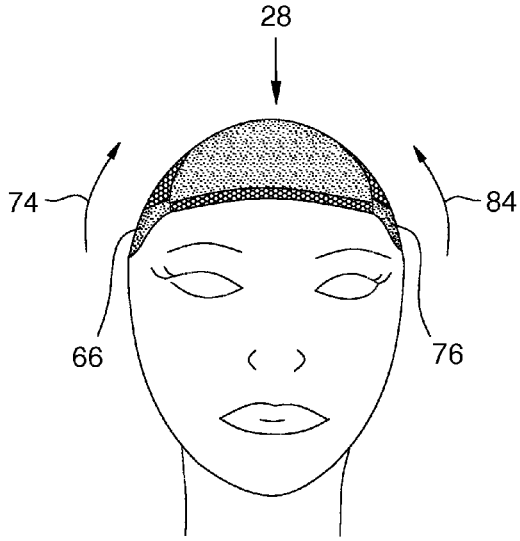
FIG. 4 is a diagrammatic front view of the embodiment shown in FIG. 3.

In embodiments, the first, second, third and fourth adjacent objects, where applicable, are typically separate portions of either the skin of the wearer or the natural hair of the wearer (more particularly, the skin or natural hair of the head of the wearer). Turning to FIGS. 3 and 4, the first, second, third and fourth frictional directions (illustrated, for example, at 50, 62, 74 and 84, respectively) are typically toward the crown portion shown generally at 28. Each frictional engagement and their respective frictional directions, individually and (where applicable) in combination, contributes to the enhanced securement of the wig 20 to the head of the wearer.

Certain embodiments may also comprise an elastic band 86 extending generally from the right periphery 34, along the rear periphery 32 and to the left periphery 36. The elastic band 86 may also have a length that is adjustable, for example, by way of a small conventional quick-release clip (not shown). In embodiments comprising an elastic band 86 with a length that is adjustable, the elastic band may be selected to be far less elastic. Certain embodiments with one or more of a second, third and fourth securement fabric element find particular utility in the inclusion of an elastic band 86 because the elastic band 86 can apply additional pressure between the securement fabric elements and their respective adjacent objects, thereby increasing the degree of frictional engagement therebetween.

The foregoing detailed description of the invention is intended to be illustrative and is not intended to limit the scope of the invention. Changes and modifications are possible with respect to the embodiments detailed in the foregoing descriptions, and it is understood that the invention may be practiced otherwise than that specifically described herein and still be within the scope of the appended claims.

The invention claimed is:

1. A wig with integral clinging foundation for enhanced securement of the wig to the head of a wearer, said wig with integral clinging foundation comprising:

a foundation base element, said foundation base element being substantially thin and flexible, said foundation base element having an inner side, an outer side, a crown portion, a forward periphery, a rear periphery, a right periphery and a left periphery;

a plurality of hair strands, each said hair strand being attached to said foundation base element and extending generally outward of said outer side;

a first securement fabric element, said first securement fabric element being flexible and having a first inner surface and a first outer surface, said first securement fabric element being in first connection with said foundation base element, said first inner surface including unidirectional piled fiber adapted to cause a first frictional engagement between said first securement fabric element and a first adjacent object in contact therewith so as to hinder movement of said first securement fabric element in a first frictional direction with respect to said first adjacent object; and a second securement fabric element, said second securement fabric element being flexible and having a second inner surface and a second outer surface, said second securement fabric element being in second connection with said foundation base element, said second inner surface including unidirectional piled fiber adapted to cause a second frictional engagement between said second securement fabric element and a second adjacent object in contact therewith so as to hinder movement of said second securement fabric element in a second frictional direction with respect to said second adjacent object;

wherein said first connection is made proximate said forward periphery, said second connection is made proximate said rear periphery, said first and second frictional directions are generally toward said crown portion, and said second securement fabric element includes a readily reshapable strip therein, the shape of said readily reshapable strip being adjustable to provide additional pressure between said second inner surface and said second adjacent object.

2. A wig with integral clinging foundation for enhanced securement of the wig to the head of a wearer, said wig with integral clinging foundation comprising:

a foundation base element, said foundation base element being substantially thin and flexible, said foundation base element having an inner side, an outer side, a crown portion, a forward periphery, a rear periphery, a right periphery and a left periphery;

a plurality of hair strands, each said hair strand being attached to said foundation base element and extending generally outward of said outer side;

a first securement fabric element, said first securement fabric element being flexible and having a first inner surface and a first outer surface, said first securement fabric element being in first connection with said foundation base element, said first inner surface including unidirectional piled fiber adapted to cause a first frictional engagement between said first securement fabric element and a first adjacent object in contact therewith so as to hinder movement of said first securement fabric element in a first frictional direction with respect to said first adjacent object;

a third securement fabric element, said third securement fabric element being flexible and having a third inner surface and a third outer surface, said third securement fabric element being in third connection with said foundation base element, said third inner surface including unidirectional piled fiber adapted to cause a third frictional engagement between said third securement fabric element and a third adjacent object in contact therewith so as to hinder movement of said third securement fabric element in a third frictional direction with respect to said third adjacent object, said third connection being made proximate said right periphery, said third frictional direction being generally toward said crown portion; and a fourth securement fabric element, said fourth securement fabric element being flexible and having a fourth inner surface and a fourth outer surface, said fourth securement fabric element being in fourth connection with said foundation base element, said fourth inner surface including unidirectional piled fiber adapted to cause a fourth frictional engagement between said fourth securement fabric element and a fourth adjacent object in contact therewith so as to hinder movement of said fourth securement fabric element in a fourth frictional direction with respect to said fourth adjacent object, said fourth connection being made proximate said left periphery, said fourth frictional direction being generally toward said crown portion;

wherein said third and fourth securement fabric element each include a readily reshapable strip therein, the shape of respective said readily reshapable strips being adjustable to provide additional pressure between said third inner surface and said third adjacent object, and between said fourth inner surface and said fourth adjacent object.

3. A wig with integral clinging foundation for enhanced securement of the wig to the head of a wearer, said wig with integral clinging foundation comprising:

a foundation base element, said foundation base element being substantially thin and flexible, said foundation base element having an inner side, an outer side, a crown portion, a forward periphery, a rear periphery, a right periphery and a left periphery;

a plurality of hair strands, each said hair strand being attached to said foundation base element and extending generally outward of said outer side;

a first securement fabric element, said first securement fabric element being flexible and having a first inner surface and a first outer surface, said first securement fabric element being in first connection with said foundation base element, said first inner surface including unidirectional piled fiber adapted to cause a first frictional engagement between said first securement fabric element and a first adjacent object in contact therewith so as to hinder movement of said first securement fabric element in a first frictional direction with respect to said first adjacent object, said first adjacent object being a portion of either the skin of said wearer or the natural hair of said wearer, said first connection being made proximate said forward periphery and said first frictional direction being generally toward said crown portion; and a second securement fabric element, said second securement fabric element being flexible and having a second inner surface and a second outer surface, said second securement fabric element being in second connection with said foundation base element, said second inner surface including unidirectional piled fiber adapted to cause a second frictional engagement between said second securement fabric element and a second adjacent object in contact therewith so as to hinder movement of said second securement fabric element in a second frictional direction with respect to said second adjacent object, said second adjacent object being a portion of either the skin of said wearer or the natural hair of said wearer, said second connection being made proximate said forward periphery and said second frictional direction being generally toward said crown portion;

wherein said second securement fabric element includes a readily reshapable strip therein, the shape of said readily reshapable strip being adjustable to provide additional pressure between said second inner surface and said second adjacent object.

4. A wig with integral clinging foundation for enhanced securement of the wig to the head of a wearer, said wig with integral clinging foundation comprising:

a foundation base element, said foundation base element being substantially thin and flexible, said foundation base element having an inner side, an outer side, a crown portion, a forward periphery, a rear periphery, a right periphery and a left periphery;

a plurality of hair strands, each said hair strand being attached to said foundation base element and extending generally outward of said outer side;

a first securement fabric element, said first securement fabric element being flexible and having a first inner surface and a first outer surface, said first securement fabric element being in first connection with said foundation base element, said first inner surface including unidirectional piled fiber adapted to cause a first frictional engagement between said first securement fabric element and a first adjacent object in contact therewith so as to hinder movement of said first securement fabric element in a first frictional direction with respect to said first adjacent object, said first adjacent object being a portion of either the skin of said wearer or the natural hair of said wearer, said first connection being made proximate said forward periphery and said first frictional direction being generally toward said crown portion;

a second securement fabric element, said second securement fabric element being flexible and having a second inner surface and a second outer surface, said second securement fabric element being in second connection with said foundation base element, said second inner surface including unidirectional piled fiber adapted to cause a second frictional engagement between said second securement fabric element and a second adjacent object in contact therewith so as to hinder movement of said second securement fabric element in a second frictional direction with respect to said second adjacent object, said second adjacent object being a portion of either the skin of said wearer or the natural hair of said wearer, said second connection being made proximate said forward periphery and said second frictional direction being generally toward said crown portion;

a third securement fabric element, said third securement fabric element being flexible and having a third inner surface and a third outer surface, said third securement fabric element being in third connection with said foundation base element, said third inner surface including unidirectional piled fiber adapted to cause a third frictional engagement between said third securement fabric element and a third adjacent object in contact therewith so as to hinder movement of said third securement fabric element in a third frictional direction with respect to said third adjacent object, said third adjacent object being a portion of either the skin of said wearer or the natural hair of said wearer, said third connection being made proximate said right periphery, said third frictional direction being generally toward said crown portion; and a fourth securement fabric element, said fourth securement fabric element being flexible and having a fourth inner surface and a fourth outer surface, said fourth securement fabric element being in fourth connection with said foundation base element, said fourth inner surface including unidirectional piled fiber adapted to cause a fourth frictional engagement between said fourth securement fabric element and a fourth adjacent object in contact therewith so as to hinder movement of said fourth securement fabric element in a fourth frictional direction with respect to said fourth adjacent object, said fourth adjacent object being a portion of either the skin of said wearer or the natural hair of said wearer, said fourth connection being made proximate said left periphery, said fourth frictional direction being generally toward said crown portion;

wherein said second, third and fourth securement fabric elements each include a readily reshapable strip therein, the shape of respective said readily reshapable strips being adjustable to provide additional pressure between said second inner surface and said second adjacent object, between said third inner surface and said third adjacent object, and between said fourth inner surface and said fourth adjacent object.

* * * * *